United States Patent [19]

Paul

[11] 4,240,009

[45] Dec. 16, 1980

[54] ELECTRONIC BALLAST

[76] Inventor: Jon D. Paul, 145 Bluxome St., San Francisco, Calif. 94107

[21] Appl. No.: 881,190

[22] Filed: Feb. 27, 1978

[51] Int. Cl.[3] ..... H05B 37/02; H05B 39/04; H05B 41/36

[52] U.S. Cl. ..... 315/224; 315/DIG. 5; 315/DIG. 7; 315/287; 315/299; 315/307; 315/308; 363/23; 331/113 A

[58] Field of Search ..... 315/307, 308, 310, 311, 315/DIG. 5, DIG. 7, 253, 287, 299, 301, 224, 194; 307/234; 363/23, 24; 328/141, 146

[56] References Cited

U.S. PATENT DOCUMENTS

| | | | |
|---|---|---|---|
| 3,967,159 | 6/1976 | Dendy et al. | 315/308 |
| 3,969,652 | 7/1976 | Herzog | 315/DIG. 7 |
| 3,999,100 | 12/1976 | Dendy et al. | 315/308 |
| 4,004,187 | 1/1977 | Walker | 315/DIG. 5 |
| 4,004,188 | 1/1977 | Cooper | 315/224 |

*Primary Examiner*—Saxfield Chatmon, Jr.

[57] ABSTRACT

An electronic ballast for starting and operating gaseous discharge lamps from a low voltage d-c source which employs a regulated inverter providing controlled high ignition voltage, constant current warm-up and constant wattage operation for one or more lamps.

17 Claims, 11 Drawing Figures

WAVEFORM FOR FIG. 6

WAVEFORMS FOR FIG. 7

DRIVER CIRCUIT

WAVEFORMS FOR FIG. 10

ELECTRONIC BALLAST

BACKGROUND OF THE INVENTION

Gaseous discharge lamps have long been operated from power lines through transformers, auto-transformers and passive components such as capacitors and chokes. Such devices are often quite bulky, heavy and have limited regulation capability. They are, of course a-c devices and are not suitable for d-c use.

Electronic ballasts having semiconductors, magnetic components and passive components may also be used to supply the lamp with the voltages and currents which it requires to start, warm-up and operate. Magnetic and reactive components may be operated at high frequencies (above 20 kHz, for example), thus reducing their size and weight. The input power may be from a low voltage d-c source. Prior electronic ballasts are described in Engel et al U.S. Pat. No. 3,590,316 which incorporates a solid state wattmeter circuit; in Dendy et al U.S. Pat. No. 3,999,100 which uses a switching regulator and commutator; and in Herzog U.S. Pat. No. 3,969,652 which includes a switching regulator, inverter and starting circuit. These ballasts have the following drawbacks:

1. Poor starting with some types of lamps because of limits in the voltage which the ballast can safely withstand and because of a lack of a "follow-on" energy source. This is needed to aid in sustaining the arc between the time that the starting pulse is applied and the time that the ballast establishes a steady-state arc current.
2. Limited hot restrike capability. When a lamp is fully warmed up, its internal pressure will be many times greater than when the lamp is cold. The magnitude of the high voltage pulse required to start the lamp when it is hot is dependent upon this gas pressure. For example, some lamps require 15 kv to cold start and 35 kv to hot start. Previous methods of starting have been limited in the highest starting voltage they could produce, and hence could start, but not hot-restrike a lamp. In many applications, it is desirable to have the lamp restrike immediately after a power interruption, without a waiting period for the lamp to cool down.
3. Certain of the previous methods use switching regulators cascaded with inverter circuits. The input voltage suffers two or three junction drops and efficiency is impaired, especially for low voltage sources.
4. The prior circuits lack protection of lamp or ballast from high d-c transients developed in the lamp circuit just after ignition. These transients are due to formation of a cathode spot on only one lamp electrode. This causes the lamp to act as a rectifier just after starting for periods of about one second. The resulting flow of d-c current in the lamp and ballast output circuit can saturate ballast magnetic components and damage the lamp and/or ballast if high currents flow.
5. The control of lamp wattage has often required the sensing of lamp voltage directly, which can result in exposure of low level circuits to the high starting voltages. Other approaches sense currents at intermediate points within the inverter circuitry where transients are often present and degrade the accuracy of measurement. Some schemes use costly analog multipliers or logarithmic techniques to determine the product of voltage and current, and hence, wattage.
6. Certain types of ballasts provide sine-wave (or non-squarewave) outputs of various frequencies. These can create acoustic arc resonance effects in some lamps, causing unstable arcs and possible destruction of the arc tube. See, for example, J. H. Campbell, "Initial Characteristics of High-Intensity Discharge Lamps on High-Frequency Power", Illuminating Engineering, December 1969, p. 713 and C. F. Scholz, "Characteristics of Acoustical Resonance in Discharge Lamps", Illuminating Engineering, December 1970, p. 713. Current square-waves provide higher lamp and ballast efficiency.

SUMMARY OF THE INVENTION

An electronic ballast is disclosed for operation of gaseous discharge lamps. In one form the circuit includes an inverter driver circuit and a regulated inverter operating from a source of d-c power. A control circuit senses the inverter's d-c input current and voltage and the output current to the lamp. This control circuit computes the input wattage and lamp current, compares them to predetermined values and controls the inverter output so as to provide constant current during warm-up and constant wattage thereafter.

Starting or restriking of the lamp is accomplished via the simultaneous application of inverter a-c output voltage, a high voltage d-c pulse applied to a trigger electrode in proximity to the lamp, and high voltage from a charged capacitor in series with the lamp power circuit. The latter two voltages are removed after lamp ignition.

During warm-up, substantially constant current a-c square-waves are applied to the lamp. Peak-to-peak current is regulated so that lamp current is limited to a specified maximum.

After warm-up, the control circuit controls lamp current to keep lamp wattage substantially constant. The control circuit includes means for selecting between constant wattage and constant current control signals so that the signal which minimizes lamp current is used for control purposes.

This electronic ballast is well-suited to operation from low voltage d-c power sources; for example, storage batteries or vehicle power systems. The ballast incorporates passive components, semiconductors and magnetic components in a regulated inverter, controlled by feedback circuitry. It is capable of operating a number of types of lamps; for example, high pressure sodium, mercury vapor, and metal doped-halogen (such as "HMI", "CSI"). The operating frequency may be considerably above common power line frequency, allowing reduction in magnetic component size and weight, increased ballast and lamp efficiency and freedom from arc "flicker" (stroboscopic) effects.

THE OBJECTS OF THIS INVENTION ARE

1. To provide an electronic ballast capable of starting, operating and restriking gaseous discharge lamps from a source of d-c power such as low voltage batteries.
2. To provide an electronic ballast of small size and weight compared to powerline low frequency magnetic ballasts so as to be well-suited for portable and vehicular applications.

3. To provide substantially a square-wave current drive to the lamp to minimize flicker and acoustic arc resonance, and to maximize efficiency of the lamp and ballast power components.
4. To regulate lamp current during lamp warm-up and lamp wattage during lamp operation.
5. To derive lamp wattage control without use of costly multiplier circuitry.
6. To provide means for starting and hot restriking of the lamp without application of high voltage pulses directly to the lamp's main electrodes.
7. To provide means to protect ballast semiconductors from high voltages present during starting.
8. To prevent the flow of d-c current in the lamp circuit during the early part of the warm-up period.
9. To provide means for operating various types of lamps from a single ballast via a switching device.
10. To provide means to turn the lamp and ballast on and off in response to an externally applied low level control signal.
11. To provide high efficiency power conversion for low voltage sources.

BRIEF DESCRIPTION OF THE DRAWINGS

The invention, together with further objects and advantages may be better understood by reference to the following descriptions in conjunction with the accompanying drawings wherein.

DESCRIPTION OF THE PREFERRED EMBODIMENT

Figure 1:
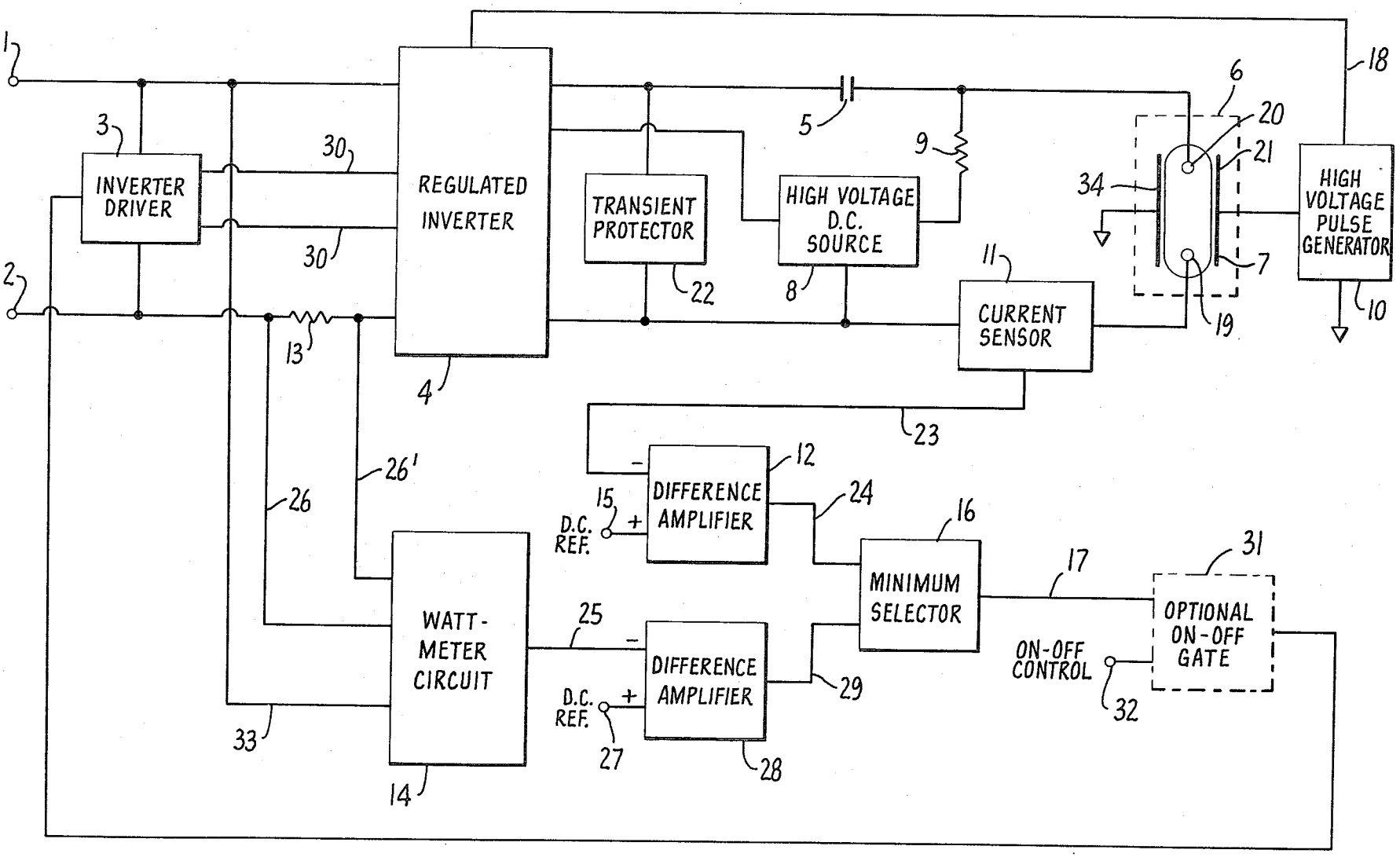
FIG. 1 is a functional block diagram of the electronic ballast.

FIG. 1 is a functional block diagram of the electronic ballast embodying one form of the invention. A d-c input from a source, such as a low voltage battery, is applied across input terminals 1 and 2. A regulated inverter 4, with square-wave a-c output connects to input terminals 1 and 2 via a low value current sensing resistor 13. The inverter is controlled and driven by inverter driver circuit 3, also connected to input terminals 1 and 2. The inverter provides regulated square-waves of current to one or more gaseous discharge lamps 6 via series capacitor 5.

The capacitor 5 is charged to a relatively high d-c voltage prior to lamp ignition via a high voltage d-c source 8 derived from the inverter output. The high voltage source charges capacitor 5 through a relatively high resistance 9. In addition, a high voltage pulse generator 10 which may be derived from the inverter output at 18, or may be independent of the inverter, applies high voltage ignition pulses to the lamp 6 at trigger electrode 7 that is independent of the main electrodes 19,20 of the lamp. The trigger electrode 7 may be situated outside the lamp envelope, 21. A ground reference, such as reflector 34, is provided in proximity to the lamp.

Immediately after lamp ignition, the charge on capacitor 5 enters the lamp and sustains ignition until the inverter can provide a stabilized arc. Means for preventing the charge on capacitor 5 from entering and possibly damaging inverter 4 are provided by shunting the inverter output with transient protector 22. It consists of varistors and/or zener diodes which limit the voltage appearing at the inverter output. These components absorb the energy sent back from capacitor 5 when the lamp is struck. During the period immediately following ignition, series capacitor 5 blocks d-c transients caused by lamp rectification.

After ignition of lamp 6, current flows through current sensor 11 connected between the lamp 6 and the inverter 4. The output of the current sensor is a d-c signal 23 proportional to the peak-to-peak value of lamp current. This signal is compared to a d-c reference voltage 15 by difference amplifier 12 the output 24 of which is the current control signal. This signal is proportional to the difference between the current sensed and the reference.

A wattage control signal 25 is derived by wattmeter circuit 14 which receives a signal proportional to the inverter d-c input current from sensing resistor 13 via connections 26,26'. Additionally, it receives inverter d-c input voltage via paths 33 and 26. Wattmeter circuit 14 uses these two inputs to compute an output 25 which is substantially proportional to the inverter input power. For efficient inverter circuitry, this power is proportional to lamp power.

The wattage output signal 25 is compared to d-c reference 27 by difference amplifier 28 which provides a wattage control signal 29 proportional to the difference between these two values. A minimum selector circuit 16 receives the current control signal 24 and wattage control signal 29 and provides an output 17 substantially equal to the lesser of the two signals present at its input. This signal 17 is fed back to the inverter driver circuit 3 which controls the inverter 4 via pulse-width modulated signals at 30. The ballast optionally may be gated on and off via a gating means 31 connected to the feedback signal path 17. The gate 31 is controlled by an externally applied control signal 32.

Figure 2:
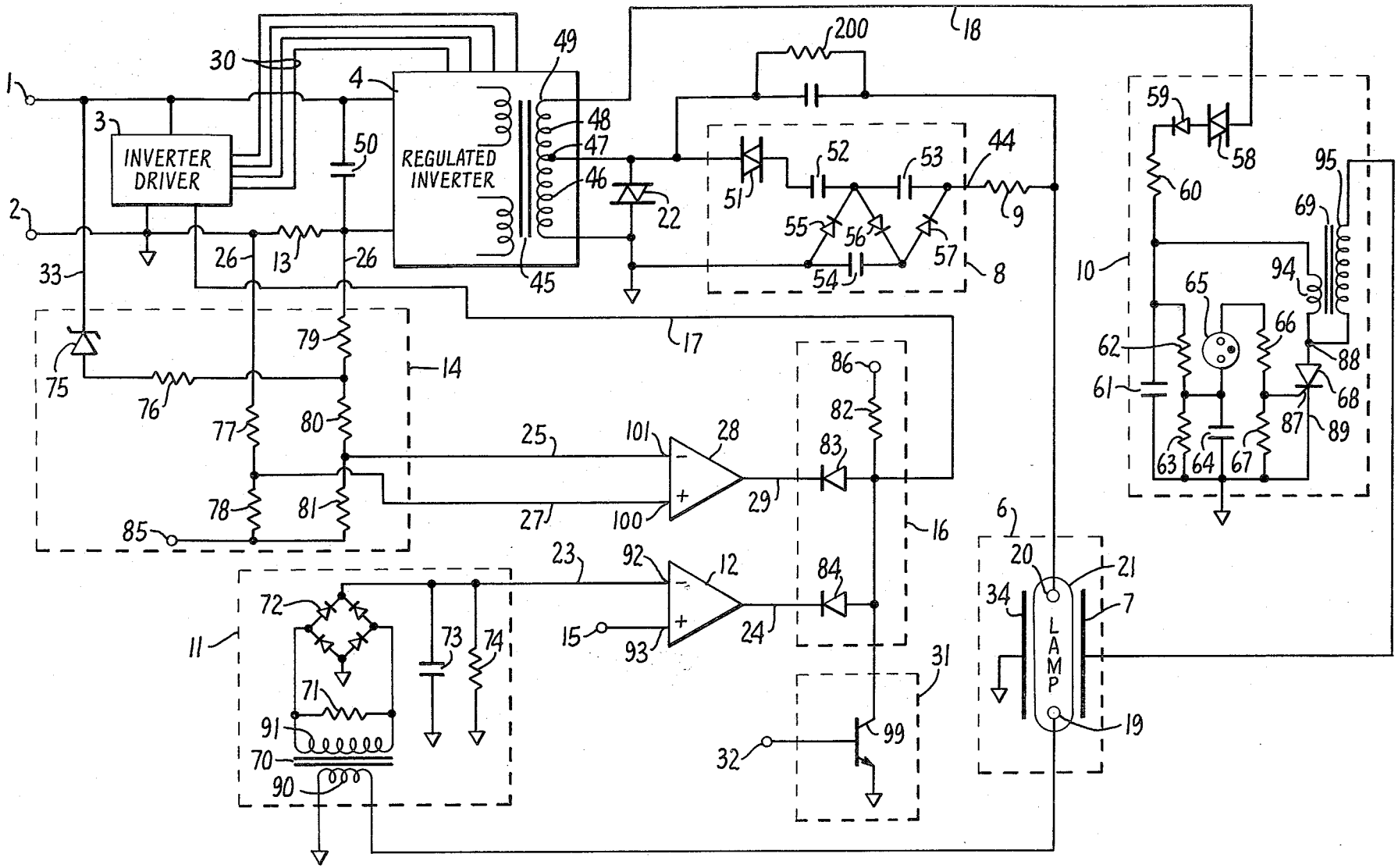
FIG. 2 is a schematic diagram of the ballast circuits.

FIG. 2 is a schematic diagram of one embodiment of the electronic ballast shown in FIG. 1. A source of d-c power connects to terminals 1 and 2. These terminals connect to a pulse-width modulated inverter driver circuit 3 and to a pulse-width modulated regulated inverter 4 with substantially square-wave output. The inverter 4 receives drive pulses from inverter driver 3 at 30. Capacitor 50 bypasses transients created by inverter switching and reduces their effect on other circuitry.

The inverter 4 is connected to d-c terminal 2 by a low value shunt resistor 13. The voltage drop across this sensing resistor is proportional to the inverter supply current.

The inverter output is square-wave a-c from the main winding 46 of transformer 45. The current square-wave is limited to some maximum voltage upon open circuit conditions by the design of the inverter. Connected across inverter output winding 46 is a transient protector 22, such as a metal-oxide type varistor, which limits the maximum voltage "kicked back" into the inverter by high voltage starting pulses. The varistor is selected to be substantially non-conductive for voltages up to the maximum open circuit voltage that the inverter can develop across main output winding 46. At some voltage level above the open circuit voltage, but below that level which can damage inverter components, the varistor conducts to shunt damaging transients to ground.

Inverter output terminal 47 supplies a-c current to one main lamp electrode 20 through series capacitor 5. In addition, inverter output terminal 47 connects high voltage d-c source 8. This source includes a varistor 51 in series with a three stage "Crockofft-Walton" voltage multiplier comprised of diodes 55, 56, 57 and capacitors 52, 53, 54. The voltage multiplier develops a d-c potential at 44 which is applied to capacitor 5 and lamp main terminal 20 through high resistance 9 to apply a high voltage charge to series capacitor 5 prior to lamp ignition. Resistor 200, in shunt with series capacitor 5, provides a high resistance path to bleed away charge on capacitor 5 when the ballast is turned off.

Inverter output transformer 45 includes an additional winding 48 connected in series with winding 46 to develop a higher voltage output at 49. That voltage connects to high voltage pulse generator 10. The pulse generator includes varistor 58 in series with diode 59, resistor 60, capacitor 61, and ground. When the a-c voltage at 49 exceeds the conduction voltage threshold level of varistor 58, the varistor conducts to charge capacitor 61 to a d-c level via diode 59 and resistor 60. The voltage across capacitor 61 is divided by resistors 62 and 63 and the divided voltage is applied to capacitor 64. When the divided voltage reaches the breakdown potential of neon-glow lamp 65, it conducts causing current flow from capacitor 64 through series connected resistors 66 and 67. A portion of the current flowing through resistor 66 enters silicon controlled rectifier (SCR) 68 through gate electrode 87 to cause previously non-conducting SCR 68 to conduct heavily from anode electrode 88 to cathode electrode 89 and ground. This places high voltage pulse transformer primary winding 94 across capacitor 61 with its stored charge. Capacitor 61 rapidly discharges its energy into transformer primary winding 94 and generates a high voltage pulse (5–45 kv. depending upon lamp) on transformer secondary winding 95. The high voltage pulse triggers electrode 7 in proximity to lamp outer envelope 21. Ground reference for the starting electric fields is provided by grounding conductive light reflector 34 and lamp main electrode 19. Thus, prior to ignition, the lamp 6 has three voltage sources applied to it: (1) the inverter open circuit a-c output voltage from transformer main output winding 46 through capacitor 5 to lamp main terminal 20 at 400 v. peak-to-peak in the circuit of FIG. 2; (2) the high voltage d-c at 44 from voltage multiplier 8 through high resistance 9 to lamp main terminal 20 at 1100 volts in the circuit of FIG. 2; and (3) the high voltage pulses from pulse generator 10 to lamp trigger electrode 7 which relaxation oscillator action in circuit 10 causes to repeat until lamp 6 starts.

The combination of these three voltages initiates lamp conduction. As soon as the lamp fill gas ionizes, the charge on series capacitor 5 flows into the lamp via the direct path to lamp main electrode 20 and the parallel paths through inverter transformer output winding 46 and varistor 22. Thereafter, the inverter current flows through ground, current sensor 11, and thence to lamp main electrode 19. The discharge of series capacitor 5 into lamp 6 rapidly increases the ionization of the arc stream. The starting process terminates as the inverter output current in winding 46 sustains the arc in lamp 6.

After starting, varistors 22, 51 and 58 assume non-conducting states because the inverter output voltages are decreased after lamp ignition relative to the open-circuit voltages present prior to starting. This causes the high voltage circuitry 8 and 10 to cease operation after lamp ignition.

After starting, lamp current flows to ground from lamp electrode 19 through the primary winding 90 of current sensor transformer 70. This induces a proportional current flow in the current transformer secondary winding 91. That proportional voltage drop across resistor 71 connected across winding 91 is rectified to pulsating d-c by bridge rectifier 72. The rectifier 72 output charges capacitor 73 connected across the rectifier d-c output terminals. Capacitor 73 has a discharge path through resistor 74. Thus, a d-c potential which is proportional to the peak-to-peak lamp a-c current is developed at 23. This d-c potential is applied to a difference amplifier 12 at its inverting input terminal 92. Amplifier 12 has its non-inverting input 93 connected to a fixed d-c reference voltage 15. The amplifier output terminal 24 provides a voltage proportional to the difference between reference voltage 15 and the voltage at 23 which is itself proportional to lamp current. This amplifier output at 24 is the lamp current feedback control signal.

The d-c power supplied to inverter 4 is proportional to the product of the voltage between terminals 1 and 2 and the current flowing through sensing resistor 13. The voltage applied is typically restricted by the nature of the source (for example, a battery) to a rather narrow range, say 20–30 volts for a 28 v. nominal source. Over such a restricted range, multiplication can be approximated by a summation of the two variables involved. Thus, the input power is approximated by a linear addition of inverter d-c input voltage minus a constant, and a voltage proportional to inverter d-c input current. If inverter 4 has small losses relative to power supplied to lamp 6, then the inverter input power will be substantially proportional to the lamp power.

Thus, wattmeter circuit 14 consists of a series connection of d-c input voltage from terminal 1, through line 33 to zener diode 75, to series connected resistors 76 and 79, and thence to the un-grounded side of current sensing resistor 13. This provides a voltage at the junction of resistors 76 and 79 which is proportional both to the inverter input current and to the inverter input voltage. A d-c reference, level shift and common mode rejection are provided by the unbalanced Wheatstone bridge circuit formed by d-c source 85 and resistors 77, 78, 80 and 81. The d-c source 85 is voltage divided by resistors 77 and 78 to furnish a d-c reference at 27 to non-inverting terminal 100 of difference amplifier 28. The inverting terminal 101 of amplifier 28 connects to the junction of resistors 80 and 81 at 25. This point is a level shifted version of the voltage present at the junction of resistors 76 and 79, shown to be substantially proportional to lamp power. Amplifier 28 furnishes an output proportional to the difference between lamp power and the reference. This is the wattage feedback control signal at 29.

Minimum signal selector circuit 16 receives the output from both difference amplifiers 28 and 12 and provides an output proportional to the lesser of the two amplifier output voltages. This circuit contains a source of positive d-c voltage 86 connected to resistor 82. Current flows from the d-c source 86 through resistor 82 and into either amplifier 28 or amplifier 12 through diode 83 or diode 84. The conducting path depends upon which amplifier has the lower output voltage at 29, and 24, respectively. The one with the higher output voltage will bias the diode connected thereto into non-conduction. The output of selector circuit 16 connects to the pulse-width modulation input of the inverter driver circuit 3 through line 17 to close the feedback loop. During lamp warm-up, lamp power will be below the operating value, and wattage control amplifier 28 will have higher output voltage at 29 than will current control amplifier 12 at 24. Thus, lamp current will control ballast output via pulse-width modulated regulation during lamp warm-up.

As the fill gas in the lamp ionizes, the lamp voltages and wattage increase until the wattage control signal at 29 becomes less than the current control signal at 24. The selector circuit 16 then causes the lamp wattage control signal 29 to control the inverter driver circuit 3 via line 17. Thus, after warm-up lamp wattage is held constant through this feedback action.

Optional switch circuit 31 provides for an external, low level signal 32 to control ballast operation. Gate circuit 31 operates by shunting feedback signal at 17 to ground through transistor 99. When the transistor is placed in a conducting state by signal 32, the inverter driver loses its d-c control signal and shuts down to turn off the ballast and lamp.

Figure 3:
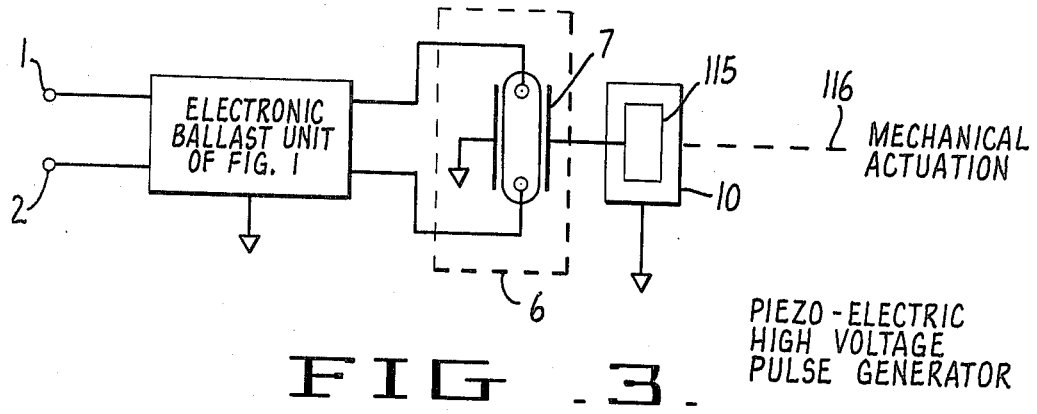
FIG. 3 is an alternative means for deriving high voltage ignition pulses.

FIG. 3 shows an alternate means for deriving the high voltage pulse used to start the lamp. The high voltage pulse generator circuit 10 of FIG. 2 is replaced with one or more mechanically actuated piezoelectric elements 115. Such elements can be made with high voltage pulse outputs sufficient to start or restrike the gas discharge lamp 6. The mechanical force 116 applied to piezoelectric element 115 can be provided by a finger operated "trigger" located on the lamp housing. The advantage of using such a starting technique is that the piezoelectric element may be much less costly than the electronic circuit 10 shown in FIG. 2.

Figure 4:
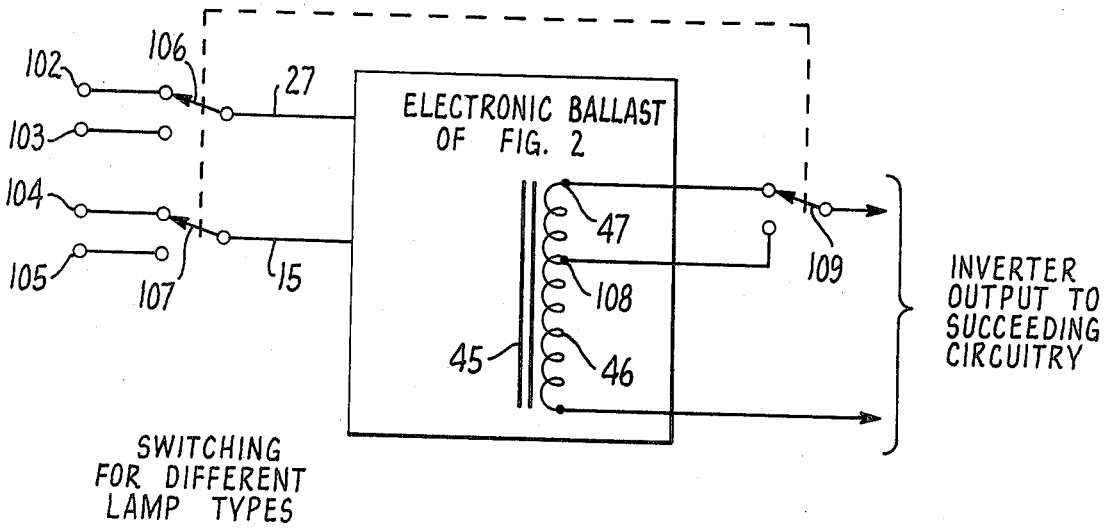
FIG. 4 is a switching circuit for use of the ballast with various lamp types, each of which requires different electrical inputs.

FIG. 4 shows a method whereby the electronic ballast of FIG. 2 may be used with various lamp types, each requiring different electrical inputs. A three pole switch selects different control circuit reference voltages and output transformer taps so as to provide different ballast parameters for various lamp types. Warm-up current reference 15 is switched by pole 107 between two different d-c voltages applied at 104 and 105. The lamp wattage is controlled by reference signal 27 at pole 106 which applies either of two d-c voltages at 102 and 103. The inverter open circuit voltage and current transformation ratio is determined by the turns ratio of output transformer 45. The output winding 46 of FIG. 2 has a tap at 108 added to it. Switch pole 109 selects between the tap 108 and the entire winding at terminal 47. Thus, a single switch changes the ballast parameters from one lamp type to another.

Figure 5:
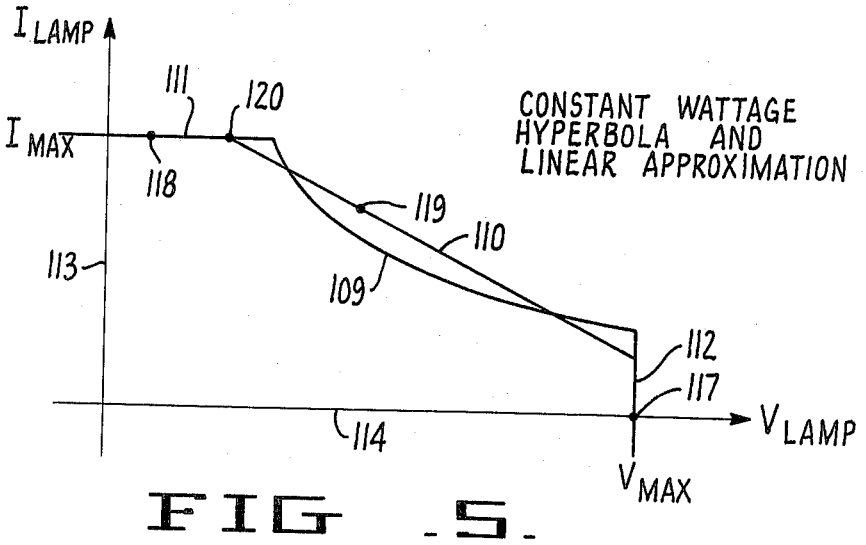
FIG. 5 is a graph of lamp current verses lamp voltage.

FIG. 5 plots lamp current versus lamp voltage. Axis 113 indicates lamp current, typically 0 to 5 amperes. Axis 114 indicates lamp voltage, which may be from 0 to 250 volts. Limit line 111 indicates the maximum lamp current available from the ballast. This value is limited by lamp current feedback circuitry at 11 and 12 of FIG. 2. The maximum voltage available is indicated by line 112 and is set by the d-c power source and the ballast transformer design.

If the lamp wattage were ideally regulated, then the locus of operating point 119 would lie on hyperbola 109. The wattmeter circuit 14 of FIG. 2, in combination with feedback circuitry at 28, provides a linear approximation 110 to this hyperbola 109.

The sequence of lamp start-up, warm-up and operation may be visualized on this diagram. Prior to lamp starting, the lamp appears as an open circuit to the ballast, and hence the maximum voltage available is impressed across the lamp. This is indicated as 117. Immediately after starting, the lamp is cold and burns at some low voltage 118, with its current limited to Imax 111. As the lamp warms up, the gas pressure and burning voltage rise. The operating point moves towards the right remaining on current limit 111 until rated lamp wattage is achieved at point 120. Then feedback minimum selector circuit 16 of FIG. 2 switches from constant current to constant wattage operation. If lamp voltage should increase, lamp current is decreased, so as to obtain operation along line 110, such as at 119, which approximates the true constant wattage hyperbola 109.

The circuit configuration of regulated inverter 4 shown in FIGS. 1 and 2 depends upon the lamp type. For lamps which can run at the high frequency at which the inverter switches, the circuit of FIG. 6 may be used. Lamps which require low frequency excitation (for example, large wattage, heavily doped, medium arc length units) may be driven using the configuration shown in FIG. 7. Although only these two circuits are illustrated, the basic ballast circuit of FIG. 1 may be realized using many other inverter configurations to provide the required regulated constant current output. Examples are those described in U.S. Pat. Nos. 4,004,188; 3,925,715; 3,949,267; 3,742,330; 4,004,187; or 4,004,188.

Figure 6:
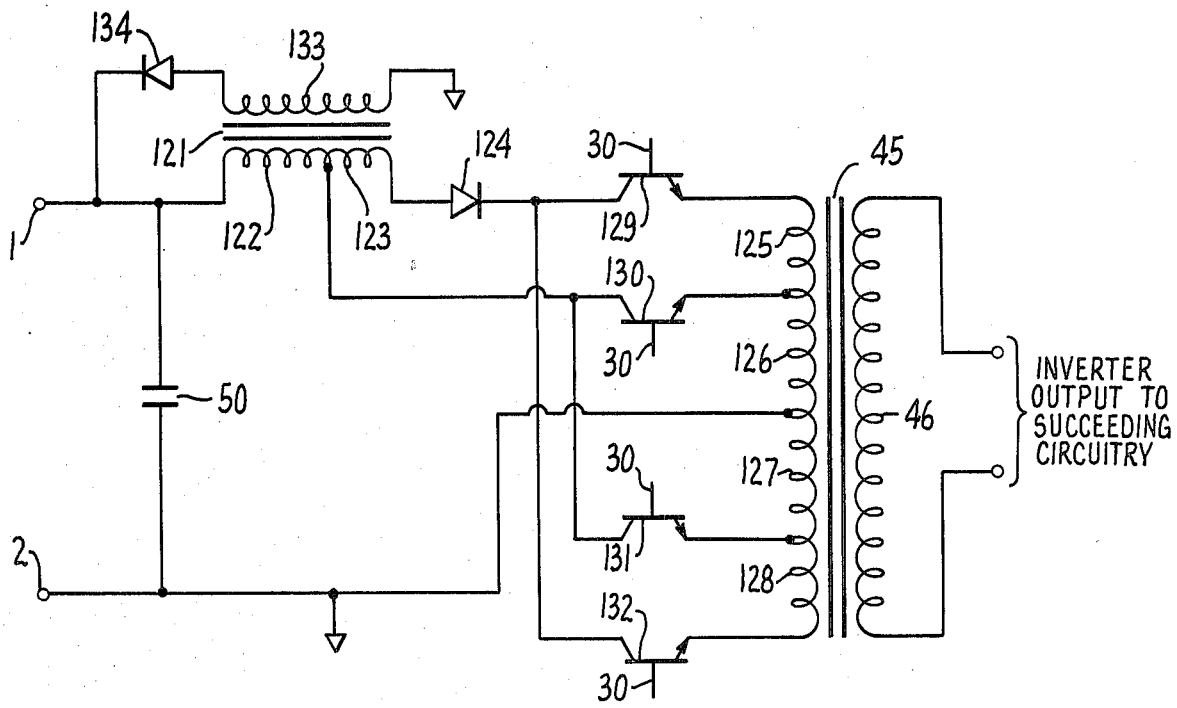
FIG. 6 is one circuit for a high frequency regulated inverter.

FIG. 6 shows a circuit comprised of an inductor 121 in series with switch elements 129, 130, 131 and 132. These are illustrated as transistors, although other devices, such as magnetic amplifiers, could be used.

Figure 8:
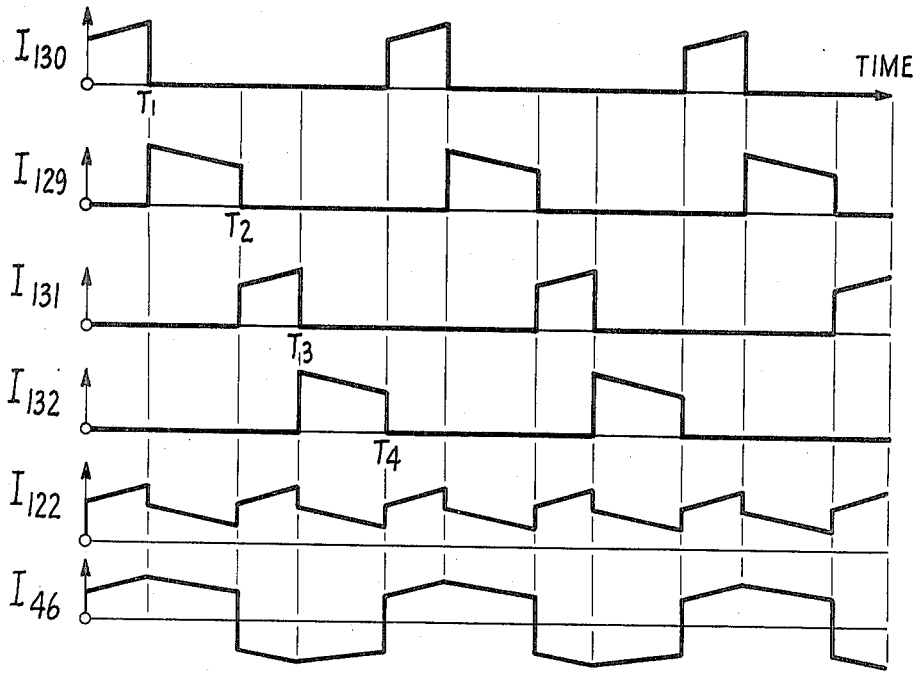
FIG. 8 is the current wave forms of the circuit of FIG. 6.

Each switch completes a path from inductor 121 to the output transformer primary windings 125, 126, 127 and 128. Drive pulses at 30 are applied sequentially to each switching device. The currents flowing through the switches are shown in FIG. 8. For time between O and $T_1$, transistor 130 conducts causing a current flow from d-c power source terminal 1, through inductor winding 122, to output transformer winding 126, and thence to grounded d-c source terminal 2. At time $T_1$, transistor 130 is turned off by drive pulse 30, and transistor 129 is turned on. Current now flows from source terminal 1, through inductor windings 122 and 123, diode 124 and transistor 129, into output transformer primary windings 125 and 126, and then to terminal 2. At time $T_2$, the half cycle ends and a similar sequence begins for the opposite side of this symmetrical circuit using transistors 131 and 132. If the turns ratios of the windings are such that $$\frac{N_{122}}{N_{123}} = \frac{N_{126}}{N_{125}} = \frac{N_{127}}{N_{128}},$$

the output current will have the waveshape shown in FIG. 8 for $I_{46}$. Neglecting slight ripple, this is a constant current square-wave output, the magnitude of which is adjusted by varying the timing of switching times $T_1$ and $T_3$ while keeping time periods O to $T_2$ and $T_2$ to $T_4$ fixed so as to maintain constant output frequency.

The current in inductor winding 122 exhibits the discontinuous waveshape shown in FIG. 8 at $I_{122}$ because of the conservation of ampere-turns on inductor 121 as winding 123 alternately conducts. Transients could be generated by "dead time" effects when all four switches are off. These transients are prevented by additional winding 133 on inductor 121 which returns energy stored in inductor 121 to the d-c source 1 through diode 134. Winding 133 is phased so that diode 134 is reversed-biased when switches 129, 130, 131 and 132 conduct. It should be noted that switches 129 and 132 need not be driven by pulse-width modulation drive wave. Diode 124 allows these devices to be driven by square waves. For proper operation, the voltage across output transformer primary winding 126 should be less than the minimum d-c supply voltage across terminals 1 and 2, and the voltage across windings 125 and 126 in series should be greater than the maximum d-c supply voltage across terminals 1 and 2. Capacitor 50 conducts high current transients during the switching transitions.

Figure 7:
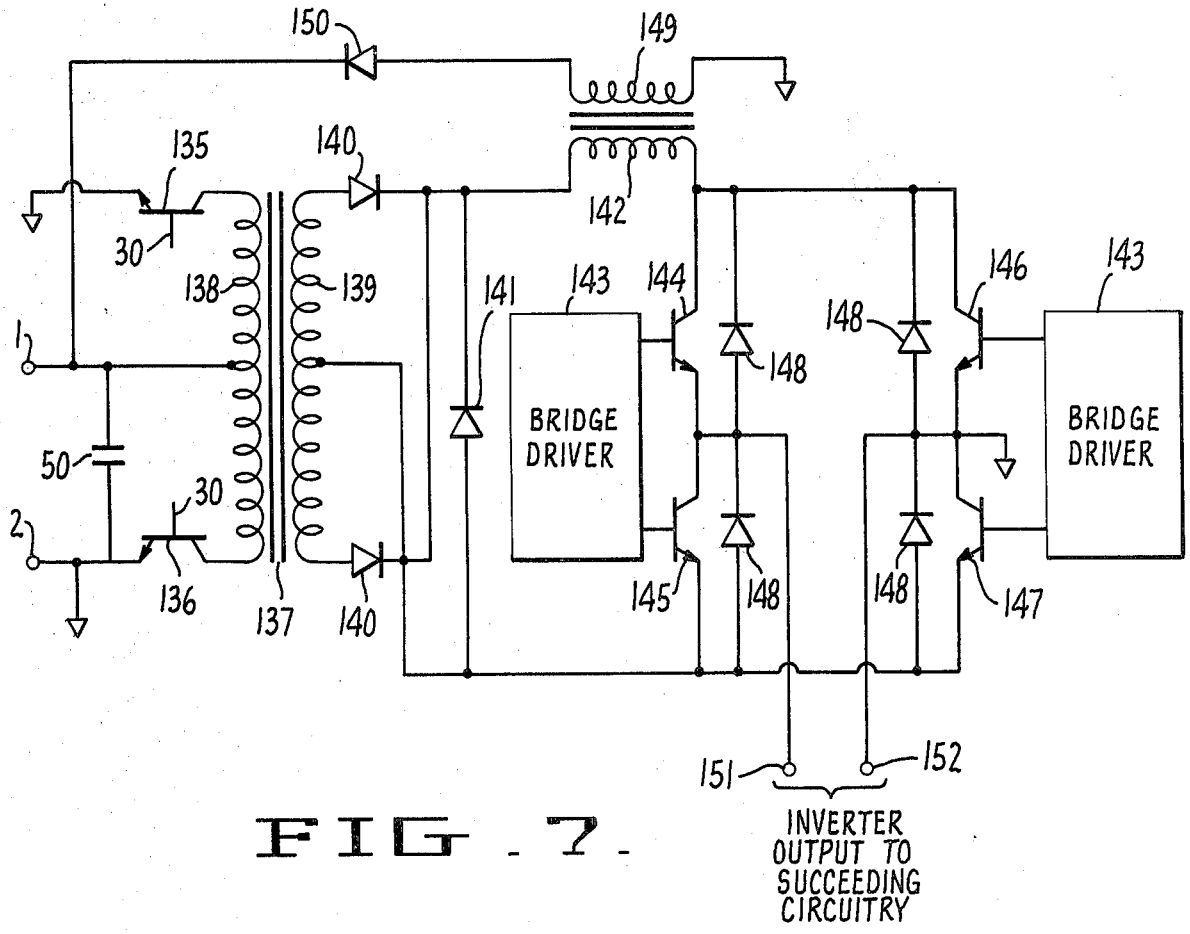
FIG. 7 is a circuit for a regulated inverter with low frequency output.

In the inverter circuit of FIG. 7 d-c power source terminal 1 connects to the transformer primary winding 138 center tap. The ends of winding 138 go through switch elements 135 and 136 to d-c power source grounded terminal 2. Driver signals 30 are alternate pulse-width modulated waveforms. The turn off times $T_1$ and $T_3$ are time modulated in accordance with d-c control signal applied to the inverter driver 3. Times O to $T_2$ and $T_2$ to $T_4$ are held constant and equal to afford constant inverter operating frequency. The drive signals 30 cause switches 135 and 136 alternately to conduct currents as shown in FIG. 9.

Figure 9:
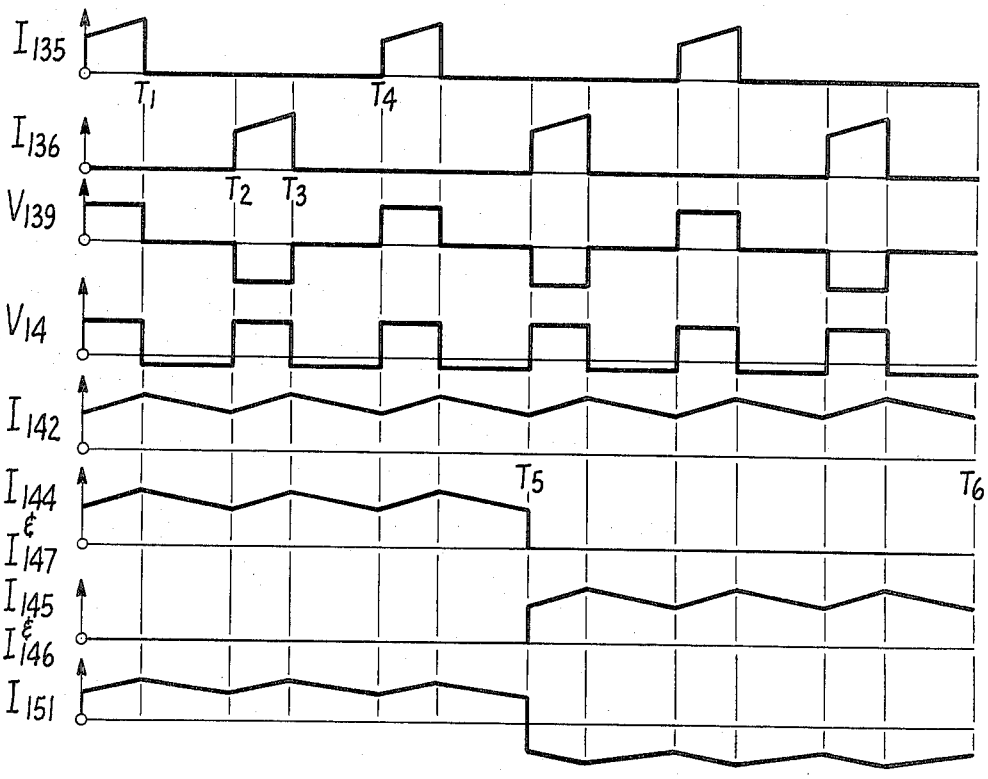
FIG. 9 is the wave forms obtained with the circuit of FIG. 7.

The inverter transformer 137 steps up the voltage and provides a pulse-width modulated "quasi square-wave" output across winding 139 illustrated in FIG. 9 as $V_{139}$. Rectifier diodes 140 rectify this "quasi square-wave" into a pulse width-modulated unipolar pulse $V_{141}$. During the time period that switch 135 conducts, diode 140 furnishes current through inductor winding 142 to the bridge inverter formed by switches 144, 145, 146 and 147, and thence to the load at output terminals 151 and 152. When switch 135 is turned off by driver signal 30, the stored energy in the inductor causes a current to flow through "free wheeling diode" 141, inductor winding 142 and through the bridge to the load. The inductor current is substantially constant as shown in FIG. 9 at $I_{142}$. The bridge is driven by square-waves of a frequency lower than that of the pulse-width modulated inverter. Drivers 143 furnish waves similar in shape to those labeled $I_{144}$, $I_{147}$ and $I_{145}$, $I_{146}$ the currents which are conducted by the bridge switches. The resultant load current is $I_{151}$ of FIG. 9.

When the bridge switches, a "dead time" effect can cause voltage transients during the period that all four switches are non-conductive. An additional winding 149 on the inductor provides a path for stored energy during such periods through diode 150 back to the d-c source. Capacitor 50 provides a low impedance path for current transients generated during switching. Diodes 148 pass voltage transients from the load (for example, during starting) around the bridge transistors. The output frequency is shown here as 1/6 the inverter frequency, and synchronized to it, but other ratios are possible and synchronization may not always be necessary.

The output current is regulated by the driver pulse-width. A low frequency output of higher voltage than the d-c source is provided. High efficiency is afforded since the input inverter circuit has only one switch in series with the input current path at one time. The diode and two switch drops in the output current path are in the lower current, higher voltage circuit.

Figure 10:
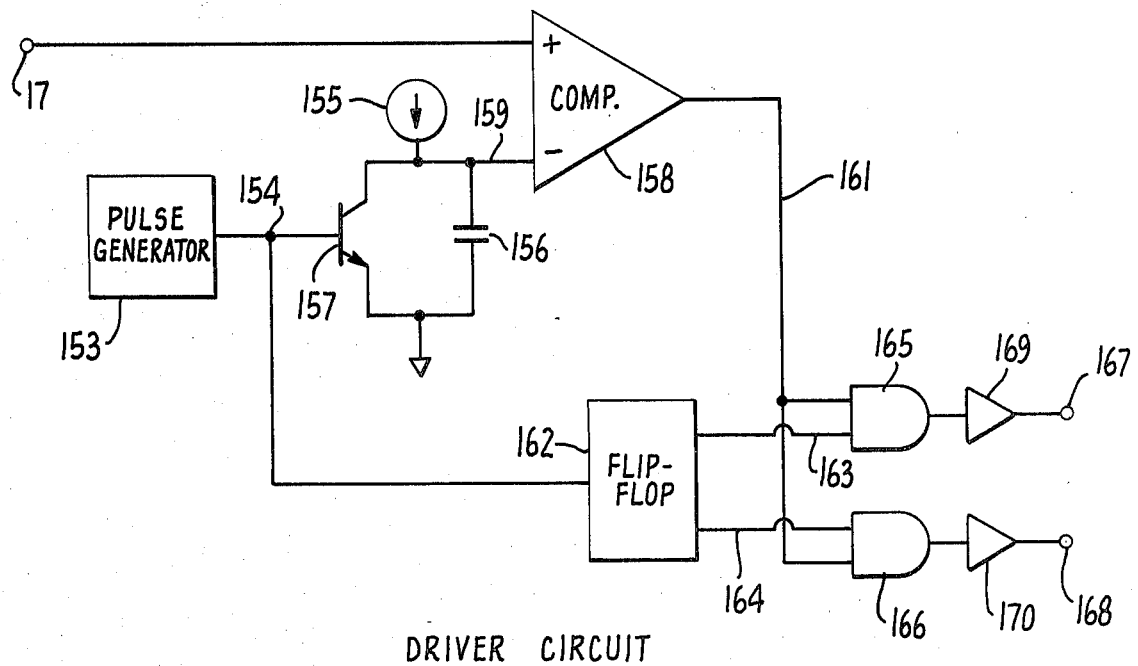
FIG. 10 is a circuit for an inverter driver.

The inverter driver 3 in FIGS. 1 and 2 has the task of furnishing pulse-width modulated alternating drive pulses to to the inverter 4 at 30. The pulse widths are proportional to the d-c control signal 17 supplied to the driver from the feedback circuitry. Of the many well-known methods of implementing such circuitry, one is shown in FIG. 10.

Figure 11:
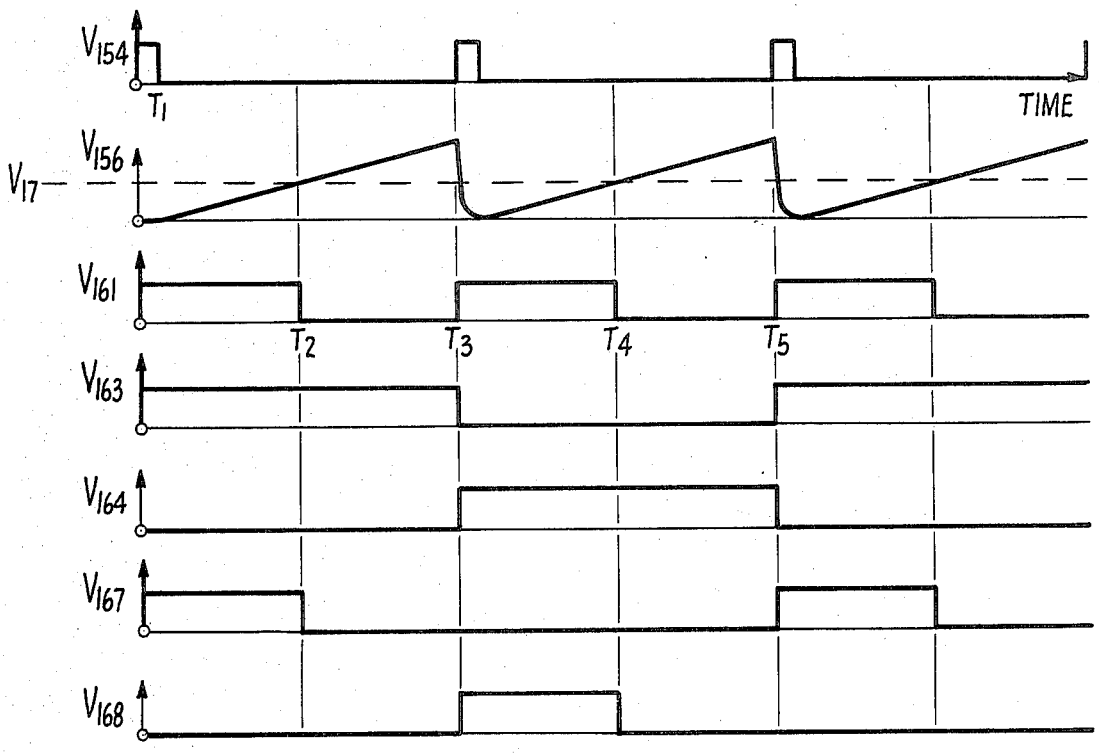
FIG. 11 is the wave forms generated by the circuit of FIG. 10.

Pulse generator 153 provides a narrow timing pulse at 154 having the waveform shown in FIG. 11 at $V_{154}$. This pulse is applied to transistor 157 and to the clock terminal of flip-flop 162. A current source 155 supplies a constant current to capacitor 156. The charge accumulated on the capacitor 156 is periodically discharged via transistor 157. This action produces a sawtooth wave with waveform $V_{156}$ of FIG. 11 applied to inverting input 159 of comparator 158. The non-inverting input 160 of the comparator connects to the d-c control signal at 17. This voltage is indicated in FIG. 11 by the dotted line $V_{17}$. The comparator output is pulse-width modulated pulse $V_{161}$. The pulse starts at time 0, when pulse generator output 154 turns on transistor 157 to discharge capacitor 156. The pulse ends at time $T_2$ when the sawtooth at comparator input 159 exceeds the d-c level at input 160.

Pulse generator 153 also causes flip-flop outputs 163 and 164 to switch at time, 0, $T_3$, $T_5$, etc. The flip-flop outputs are $V_{163}$ and $V_{164}$. Gates 165 and 166, each receive a flip-flop output 163, 164, respectively, and also the comparator output 161. The gates provide an alternating pulse-width modulated output which amplifiers 169 and 170 raise in power level to drive the inverter switches shown in FIG. 11 as $V_{167}$ and $V_{168}$. The driver circuit, with the possible exception of output amplifiers 169 and 170, may be realized as a single integrated circuit.

The foregoing description of circuit components is provided for illustrative purposes. Variations will be apparent to those skilled in this art within the scope of the invention defined in the following claims.

I claim:

1. An electronic ballast for starting and operating at least one gaseous discharge lamp including:

(a) means providing a source of d-c electrical input power;

(b) a regulated inverter connected to the source for producing a-c output power;

(c) an inverter driver controlling and driving the regulated inverter; and (d) control circuit means for the inverter driver sensing the input d-c power and output a-c current to provide constant current a-c power from the inverter during lamp warmup and constant wattage a-c power thereafter.

2. An electronic ballast for starting and operating at least one gaseous discharge lamp including:

(a) means providing a source of d-c electrical input power;

(b) a regulated inverter connected to the source for producing a-c output power;

(c) an inverter driver controlling and driving the regulated inverter; and (d) control circuit means for the inverter driver sensing the input d-c power and output a-c current to provide constant current a-c power from the inverter during lamp warmup and constant wattage a-c power thereafter, said control circuit means including a wattmeter to simulate operating lamp wattage from the d-c electrical input power and produce a wattage control signal; means sensing the a-c current output of the regulated inverter to produce a current control signal; and minimum selector means developing an inverter driver control signal which is related to the lesser of the wattage control and current control signals.

3. The electronic ballast of claim 2 wherein the inverter is regulated by pulse-width modulation from the inverter driver in response to the inverter driver control signal.

4. The electronic ballast of claim 1 further including (e) a series capacitor normally connecting a-c output power to one electrode of the lamp; and (f) a high voltage d-c source for charging the series capacitor to a high voltage prior to ignition of the lamp.

5. The electronic ballast of claim 4 wherein the high voltage d-c source for charging the series capacitor is energized by the regulated inverter.

6. The electronic ballast of claim 1 further including:

(g) high voltage pulse generating means to initiate discharge of the gas fill in the at least one gaseous discharge lamp.

7. The electronic ballast of claim 4 further including:

(h) high voltage pulse generating means to initiate discharge of the gas fill in the at least one gaseous discharge lamp.

8. The electronic ballast of claim 7 wherein the high voltage pulse generator is energized by the regulated inverter.

9. The electronic ballast of claim 7 wherein the high voltage pulse generator is a piezoelectric element.

10. The electronic ballast of claim 7 further including:

(i) transient voltage protection means connected across the output of the regulated inverter.

11. The circuit of claim 10 wherein the transient voltage protection means is a metal-oxide type varistor selected such that it is substantially non-conductive for voltages up to the maximum open circuit voltage which can be developed across the main output winding of the regulated inverter, but strongly conductive at a level above the open circuit voltage and below the level which can damage the inverter components.

12. The circuit of claim 4 wherein the high voltage d-c source for charging the series capacitor includes a multi-stage voltage multiplier circuit.

13. The electronic ballast of claim 7 whereby starting of the lamp is effected by simultaneous application of three voltages to the lamp including the a-c open circuit voltage of the regulated inverter applied directly to the lamp main terminal electrodes, the d-c voltage developed across said series capacitor and high voltage pulses supplied to the lamp trigger electrode by said high voltage pulse generating means.

14. A regulated inverter comprising a transformer having a center-tapped primary and secondary windings;

d-c input means connected across the center tap and each end of the primary winding;

a separate switch means coupled to each end of the primary winding;

an inverter driver supplying alternate control pulses in sequence to the switch means;

a bridge inverter supplying a load and being driven at a frequency lower than the control pulses to said switch means;

an inductor connecting the bridge inverter to rectified output of the transformer center-tapped secondary winding; and a free-wheeling diode connecting said inductor to the rectified output return to provide a path for inductor current when both switch means are off.

15. The regulated inverter of claim 14 wherein the control pulses to the switch means are pulse width modulated and said inverter supplies a pulse width modulated quasi-square wave output to the rectifier and inductor means.

16. A high efficiency regulated inverter comprising:

input means for receiving d-c power;

an inductor having first and second windings, said first winding for conducting a first current, said first and second windings for conducting a second current, said inductor being coupled to said input means;

a diode having first and second electrodes, said first electrode being coupled to said second inductor winding;

first and second square wave generators;

first and second pulse generators;

a transformer having first, second, third and fourth primary windings, said first winding for providing a first current path, said first and second windings for providing a second current path, said third winding for providing a third path, said third and fourth windings for providing a fourth current path, said transformer having a secondary winding;

a first transistor having first, second, and third electrodes, said first electrode of said transistor being coupled to said second electrode of said diode, said second electrode of said transistor being coupled to said first square wave generator, said generator for controlling said transistor, said third electrode of said transistor being coupled to said primary winding for conducting said second current through said second current path;

a second transistor having first, second and third electrodes, said first electrode of said transistor being coupled to said first inductor winding, said second electrode of said transistor being coupled to said first pulse generator, said generator for controlling said transistor, said third electrode of said transistor being coupled to said primary winding for conducting a first current through said first current path for a second predetermined period of time;

a third transistor having first, second and third electrodes, said first electrode of said transistor being coupled to said first inductor winding, said second electrode of said transistor being coupled to said second pulse generator, said generator for controlling said transistor, said third electrode of said transistor being coupled to said primary winding for conducting a first current through said third current path for a third predetermined period of time;

a fourth transistor having first, second and third electrodes, said first electrode of said transistor being coupled to said second electrode of said diode, said second electrode of said transistor being coupled to said second square wave generator, said generator for controlling said transistor, said third electrode being coupled to said primary winding, said transistor for conducting a second current through said fourth current path for a fourth predetermined period of time;

control means to said first, and second square wave generators and to said first and second pulse generators for controlling the pulse width of said first and second pulse generators and for controlling the output of said converter and for maintaining the output of said first and second square wave generators at a predetermined phase relationship; output means connected to said transformer secondary winding.

17. A high efficiency regulated inverter comprising:

input means for receiving d-c power;

an inductor having a first winding, connected between first and second inductor terminals, and a second winding, connected between second and third inductor terminals, said first inductor terminal being coupled to said input means;

a diode having first and second electrodes said first electrode being coupled to said third inductor terminal;

first and second square wave generators;

first and second pulse generators;

a transformer having first, second, third and fourth primary windings, said first winding being coupled between first and second terminals, said second winding being coupled between first and third terminals, said third winding being coupled between second and fourth terminals, said fourth winding being coupled between fourth and fifth terminals, said second terminal being coupled to said input means, said transformer having a secondary winding;

a first transistor having first, second and third electrodes, said first electrode being coupled to said second electrodes, said first electrode being coupled to said second electrode of said diode, said second electrode of said transistor being coupled to said first square wave generator, said generator for controlling said transistor, said third electrode of said transistor being coupled to said third transformer terminal, said transistor for conducting current through first and second transformer windings during a first predetermined period of time;

a second transistor having first, second and third electrodes, said first electrode of said transistor being coupled to said second terminal of said inductor, said second electrode of said transistor being coupled to said first pulse generator, said generator for controlling said transistor, said third electrode of said transistor being coupled to said first transformer terminal, said transistor for conducting current through said first transformer winding for a second predetermined period of time;

a third transistor having first, second and third electrodes, said first electrode of said transistor being coupled to said second terminal of said inductor, said second electrode of said transistor being coupled to said second pulse generator, said generator for controlling said transistor, said third electrode of said transistor being connected to said fourth transformer terminal, said third transistor for conducting current through said third winding for a third predetermined period of time;

a fourth transistor having first, second and third electrodes, said first electrode of said transistor being coupled to said second electrode of said diode, said second electrode of said transistor being coupled to said second square wave generator, said generator for controlling said transistor, said third electrode of said transistor being coupled to said fifth transformer terminal, said transistor for conducting current through said third and fourth windings for a fourth predetermined period of time, control means coupled to said first and second square wave generators, and to said first and second pulse generators for controlling the pulse width of said first and second pulse generators for controlling the output and for maintaining the output of said first and second square wave generators at a predetermined phase difference; and output means connected to said transformer secondary winding.

* * * * *